US005732512A

United States Patent [19]

Ueno et al.

[11] Patent Number: 5,732,512

[45] Date of Patent: Mar. 31, 1998

[54] MANHOLE OPENING STRUCTURE

[75] Inventors: Takashi Ueno, Tokyo; Tsutomu Taneichi, Hachinohe, both of Japan

[73] Assignees: Nippon Koshuha Steel Co., Ltd., Tokyo; Koshuha Foundry Co., Ltd., Aomori-Ken, both of Japan

[21] Appl. No.: 656,409

[22] Filed: May 30, 1996

[30] Foreign Application Priority Data

Jan. 12, 1996 [JP] Japan ..... 8-000429 U
Jan. 12, 1996 [JP] Japan ..... 8-022103

[51] Int. Cl.[6] ..... E02D 29/14

[52] U.S. Cl. ..... 52/19; 52/20; 405/25; 405/26

[58] Field of Search ..... 52/19, 20, 21; 404/25, 26

[56] References Cited

U.S. PATENT DOCUMENTS

| | | | |
|---|---|---|---|
| 1,076,386 | 10/1913 | O'Day | 404/26 |
| 2,930,295 | 3/1960 | Hale | 404/26 |
| 3,858,998 | 1/1975 | Larsson et al. | 52/19 X |
| 4,412,404 | 11/1983 | Manning | 52/19 |
| 5,375,940 | 12/1994 | Kobayashi | 52/19 X |
| 5,511,898 | 4/1996 | Pettesch et al. | 52/20 X |

FOREIGN PATENT DOCUMENTS

| | | | |
|---|---|---|---|
| 2618468 | 1/1989 | France | 52/20 |
| 255427 | 10/1988 | Japan | 52/19 |
| 717261 | 2/1980 | U.S.S.R. | 52/19 |

*Primary Examiner*—Carl D. Friedman
*Assistant Examiner*—Kevin D. Wilkens
*Attorney, Agent, or Firm*—Ratner & Prestia

[57] ABSTRACT

A manhole opening structure having a cover traveling rail on which at least one manhole cover can travel between a manhole opening and the ground and rail lifter serving to upwardly and downwardly move the cover traveling rail between a lower position where the manhole cover closes the manhole opening and an upper position where the manhole cover can move between the cover traveling rail and the ground.

4 Claims, 11 Drawing Sheets

MANHOLE OPENING STRUCTURE

FIELD OF INVENTION

The present invention relates to manhole covers generally, and in particular to a manhole cover opening and closing apparatus.

BACKGROUND OF THE INVENTION

This invention relates to a manhole opening structure suitably used for a manhole provided in such places as a covered conduit structure for water supply and drainage, or an underground utility runnel for underground power supply cables and communication cables. More particularly, this invention relates to a cover opening and closing structure adapted to open and close a manhole, and to an adjusting mechanism, to be fastened to a manhole body, and adapted to adjust the height and inclination of a cover supporting frame.

FIG. 9 shows a prior art manhole cover 1, which may be metal, a cover supporting frame 2, which may also be metal, for supporting the manhole cover 1 by engaging the cover 1 with the supporting frame 2, and a ring-like spacer or spacers 3 which may be formed of concrete, metal or any other material. The cover supporting frame 2 is fastened through the spacer 3 to the manhole body 5 on an upper face 5A by fastening bolts 4. The spacer or spacers 3 serve to adjust the height of the manhole cover 1 which is mounted on the manhole body 5 so that the upper face of the manhole cover 1 is aligned with the surface of the road or sidewalk.

FIG. 10 shows the spacer 3 positioned between the upper face 5A of the manhole body 5 and the outer flange 2A of the supporting frame 2. The fastening bolts 4, extending through bolt extending holes 2B and 3A in the outer flange 2A of the supporting frame 2 and the spacer 3, are tightly threaded into insert nuts 6 which are inserted or buried in the manhole body 5. The upper faces of the insert nuts 6 are exposed to the upper face of the manhole body 5 to allow the fastening of the supporting frame 2 onto the manhole body 5.

FIG. 11 shows an embodiment where the spacer 3 is not used. Here, adjusting nuts 8A are threaded onto fastener bolts 7 which are in turn threaded into the insert nuts 6 such that the height of the supporting frame 2 may be adjusted. Fastening nuts 8B are tightly threaded onto the fastener bolts 7 such that the supporting frame 2 is secured between the adjusting nuts 8A and the fastening nuts 8B. Mortar 9 is filled in between the lower face of the outer flange 2A of the supporting frame 2 and the opening upper face 5A of the manhole body 5, so as to sealingly close the space between the supporting frame 2 and the manhole body 5.

The manhole can be opened by lifting and removing the manhole cover 1 out of the supporting frame 2 and closed by setting it back into the supporting frame 2. Some of the covers 1 may have an area of 400 min×800 mm, and may weigh 200 kg or more. This makes it difficult to manually lift the manhole cover.

Though not shown, there exists a prior art manhole opening structure in which a manhole cover is hinged such that it moves pivotally when opened or closed.

In such a manhole opening structure, a force of about 70 kg to 80 kg is required for opening and closing the manhole. The manhole cover can be forcibly lifted, but it is difficult to slowly lower the cover back onto the supporting frame while the weight of the cover is being held by an operator. Often, the manhole cover is dropped into the supporting frame to close the manhole with attendant shock. This causes the block to be stripped off from the upper face of the manhole cover and, as a result, the block and the manhole cover to be cracked.

Once the block is stripped off and/or cracked, it tends to be frequently removed out of the manhole cover when the manhole is opened. Since a new block cannot be attached to the manhole cover unless the old block is completely removed out of the manhole cover, it is disadvantageous, in that it takes much time for the manhole cover to be repaired.

An additional problem with past designs concerns the introduction of dust, earth, or sand between the supporting frame 2 and the manhole cover 1. As a result of this accumulated debris, the opening and dosing of the manhole is hindered.

In the aforementioned prior art of FIGS. 9 and 10, in which the height of the supporting frame 2 is adjusted by the spacer or spacers 3, various spacers of different thicknesses have to be prepared. Also, fine adjustments are difficult because the range of adjustment is determined by the thickness of the spacers.

Yet another problem with past designs is seen where the road surface GL has an inclination of about 2% or more to allow good drainage of the road surface. Since the manhole body 5 is normally installed so that the upper face of the manhole body 5 is horizontal, spacers 3 of different thicknesses are provided on the upper face of the manhole body 5 in order to install the supporting frame 2 in an inclined manner corresponding to the inclination of the road surface GL (see FIG. 11, for reference). More particularly, semicircular spacer 3 is required to have a thickness larger than that of the other semicircular spacer 3 and the difference between the two semicircular spacers 3 is required to correspond to the inclination of the road surface GL. Thus, it is seen that the selection and installment of the spacers 3 will add installation time.

In the aforementioned prior art of FIG. 11, in which the adjusting nuts 8A are threaded onto the fastener bolts 7, the adjusting nuts 8A are required to rotate after the supporting frame 2 is lifted from the upper face 5A. Additionally, the length of the fastener bolts 7 must be adjusted by cutting them to the height of the supporting frame 2. This also increases installation time.

Furthermore, since the manhole body 5 tends to irregularly sink or go down as time elapses so that the road surface GL and the upper face 1A of the manhole cover 1 are no longer flush, the manhole cover 1 must be adjusted over time.

The conventional supporting frame 2 comprises a vertical wall 2C, a horizontal outer flange 2A integrally provided at a lower end of the vertical wall 2C, and reinforcement ribs 2D vertically extending between the vertical wall 2C and the outer flange 2A. Therefore, when the supporting frame 2 is adjusted, the ground portion A around the periphery of the supporting frame 2 must be excavated to allow the outer flange 2A to be exposed as shown in FIGS. 10 and 11. Then, the supporting frame 2 has to be removed from the opening upper face 5A of the manhole body 5. After that, the adjustment of the supporting frame 2 is made by the spacer or spacers 3, the adjusting nuts 8A, and the fastening nuts 8B.

It should be noted that there are various troublesome operations of extensively digging the ground around the periphery of the supporting frame 2, burying the supporting frame 2 after adjusting its height, and replacing the road or sidewalk. Additionally, protrusions of the supporting frame 2 such as the outer flange 2A and reinforcement ribs 2D obstruct the operation of digging the ground portion A around the periphery of the supporting frame 2. Thus, the operation of adjusting the height of supporting frame 2 can be done only manually, and is time consuming and labor intensive.

SUMMARY OF THE INVENTION

It is a principal object of the present invention to provide a manhole opening structure adapted to facilitate a more easily opened manhole cover, to lower the required force needed for removal, to decrease maintenance requirements, and to decrease damage to the manhole cover.

It is another object of the present invention to provide a mechanism for adjusting the height and/or inclination of a supporting frame, which is removably fastened to a manhole body and on which a manhole cover is supported.

In accordance with one aspect of the present invention, there is provided a manhole opening structure comprising a supporting frame fastened to a manhole body on an upper face. At least one manhole cover is provided to close an inlet portion in the supporting frame at the center of the manhole. Wheels are provided on the manhole cover, and a pair of cover traveling rails are provided in parallel to each other along the inner faces of the inlet portion. The rails support the manhole cover where the wheels are mounted on the cover traveling rails. A rail lifter is also provided to move the rails upwardly and downwardly. When the rails move downward, the manhole cover closes the inlet portion of the supporting frame. The inlet portion of the supporting frame is opened by the manhole cover moving out of the supporting frame when the wheels travel along the rails as the rails are lifted.

In accordance with another aspect of the present invention, there is provided an adjusting mechanism for a supporting frame on which a manhole cover is supported comprising adjusting bolts threadedly engaging support portions provided on the supporting frame so that the adjusting bolts move upwardly and downwardly when they rotate, and engage thrust pads on an opening upper face of a manhole in a heed manner. This structure supports said adjusting bolts so that said adjusting bolts can rotate while they are able to be angularly displaced relative to the thrust pads.

BRIEF DESCRIPTION OF THE DRAWINGS

The above and other objects and features of the invention will be apparent from the description of the embodiment of the invention taken along with the accompanying and subjoined claims in which:

DETAILED DESCRIPTION OF THE EMBODIMENT

Figure 1:
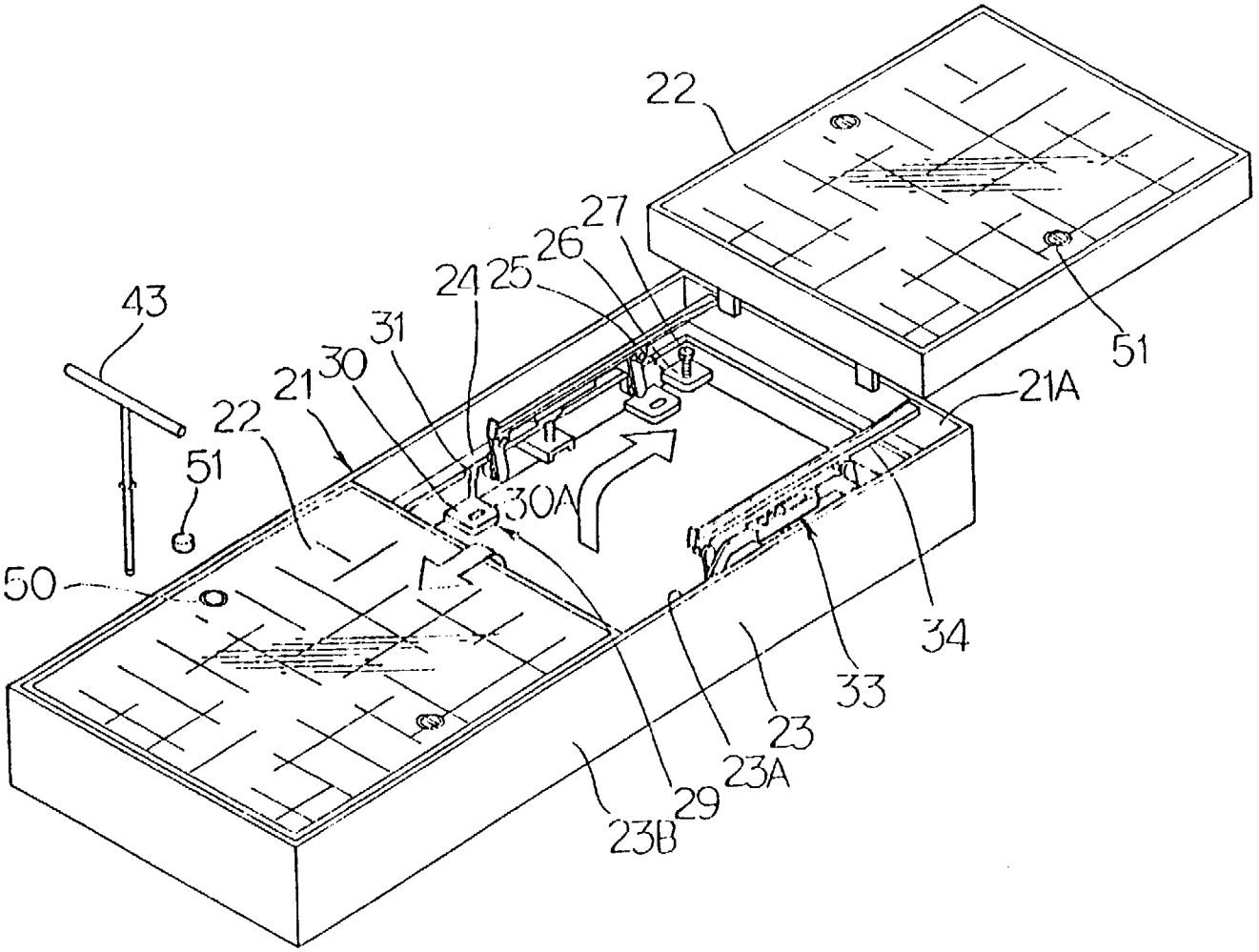
FIG. 1 is a perspective view of two manhole covers and a supporting frame which constitute a manhole opening structure of the invention with one of the manhole covers shown in the open position.

The invention will be described with reference to an embodiment shown in FIGS. 1 through 8. A supporting frame 21 is provided on an upper face 5A of a manhole body 5. The supporting frame 21 as well as the manhole body 5 may be rectangular. In the illustrated embodiment, two manhole covers 22 and 22 of the same construction may engage and close an inlet portion 21A in the center of supporting frame 21. As shown in FIG. 4, the manhole covers 22 and 22 may be supported on a supporting flange 24 provided at an upper portion of a side wall 23 of the supporting frame 21 on an inner face 23A.

Figure 7:
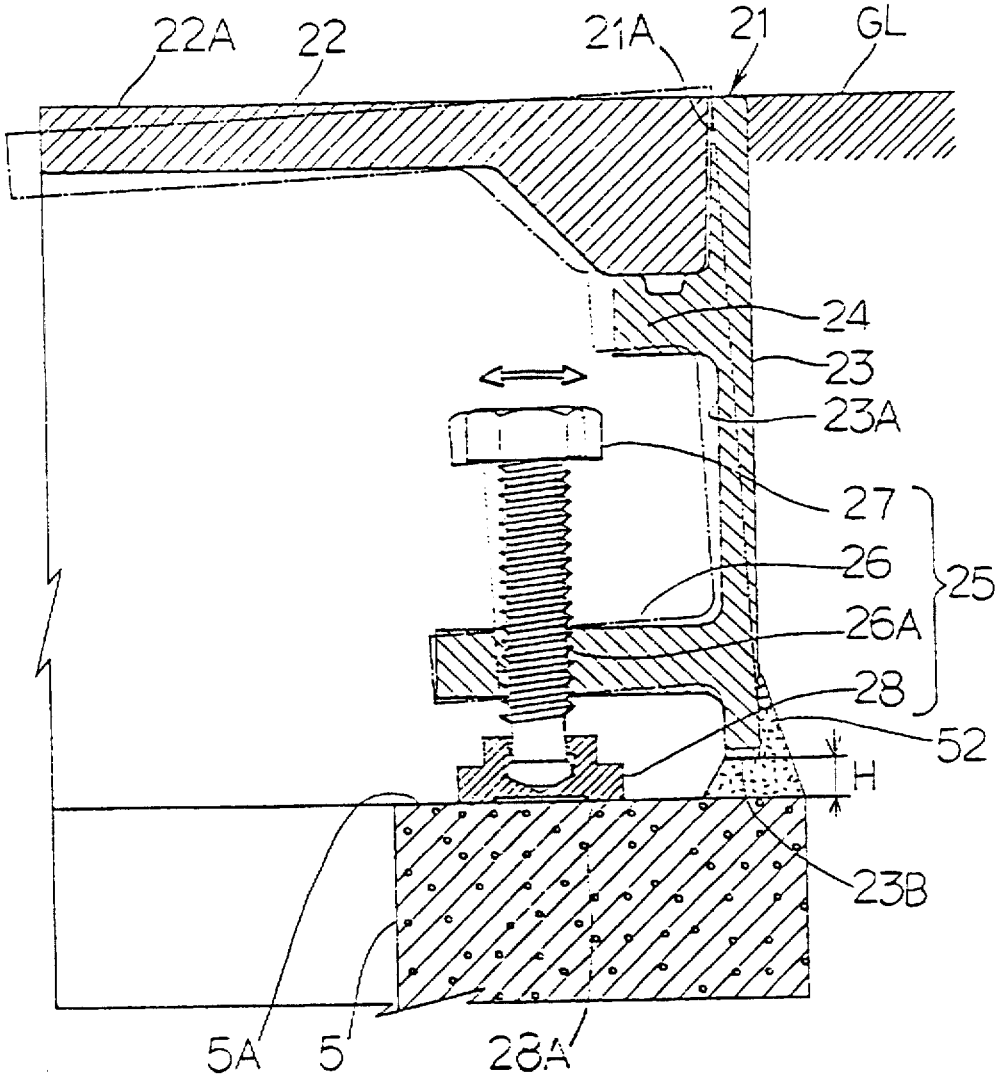
FIG. 7 is an enlarged and cross sectional view of a portion of the adjusting mechanism of FIG. 6.

There is provided a mechanism 25 for adjusting the height and/or inclination of the supporting frame 21 which includes adjusting mechanism portions provided at four corners and center portions of the inlet portion 21A in the supporting frame 21. As shown in FIG. 7, each of the adjusting mechanism portions may comprise a support portion 26 horizontally extending from the side wall 23 at a position which is adjacent to, but slightly higher than, a lower edge of the side wall 23. Adjusting bolt 27 threadedly engages the support portion 26 at a female threaded hole 26A and moves upwardly and downwardly when it is rotated. Thrust pad 28 is provided at the lower end of the adjusting bolt 27 so that the adjusting bolt 27 can rotate while it is able to be angularly displaced relative to the thrust pad 28.

Figure 8:
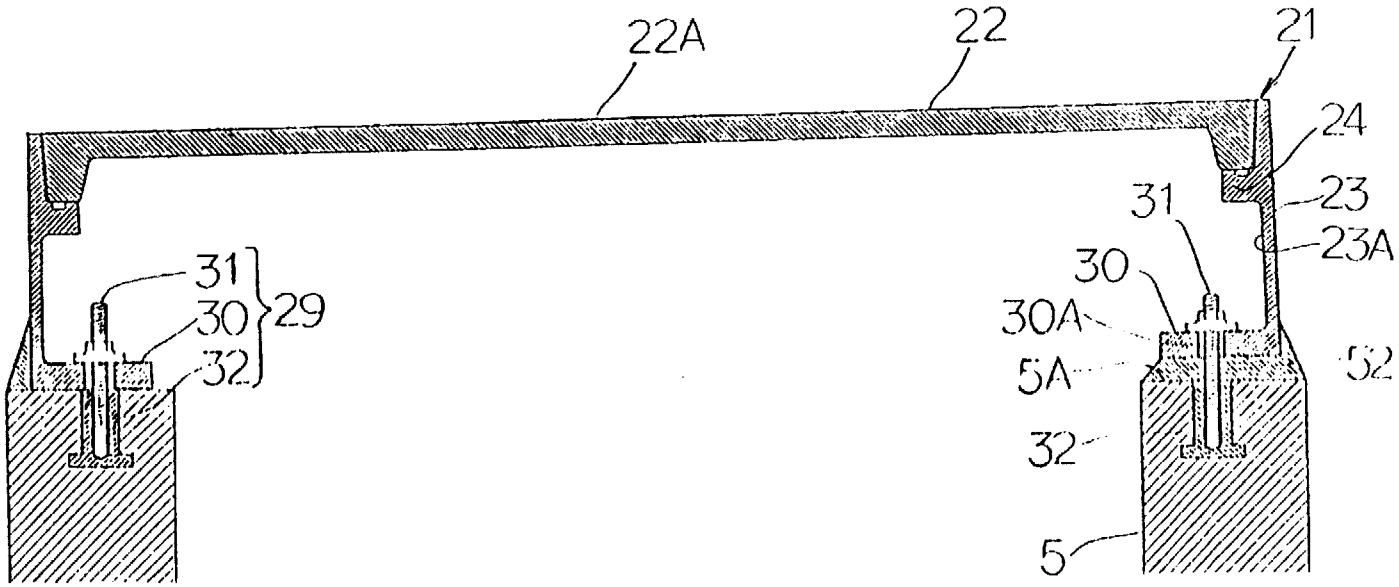
FIG. 8 is a cross sectional view of a fastener means to fasten the supporting frame to the manhole body.
Figure 9:
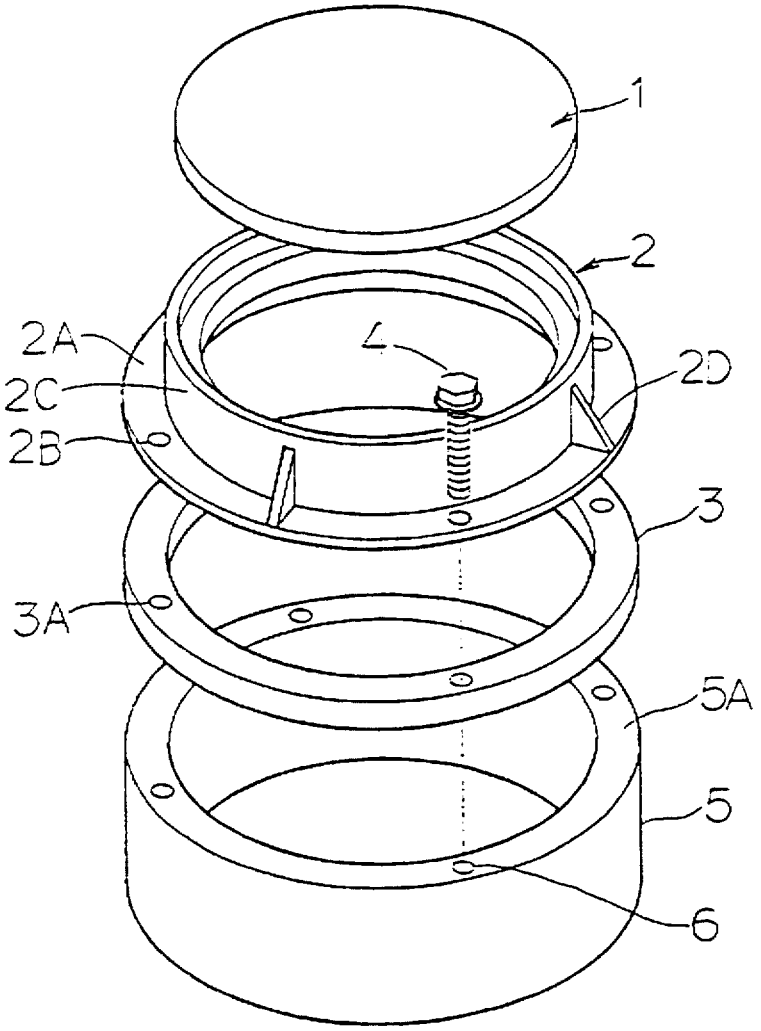
FIG. 9 (PRIOR ART)
FIG. 9 is an exploded and perspective view of a manhole opening structure constructed in accordance with one of the prior arts.
Figure 10:
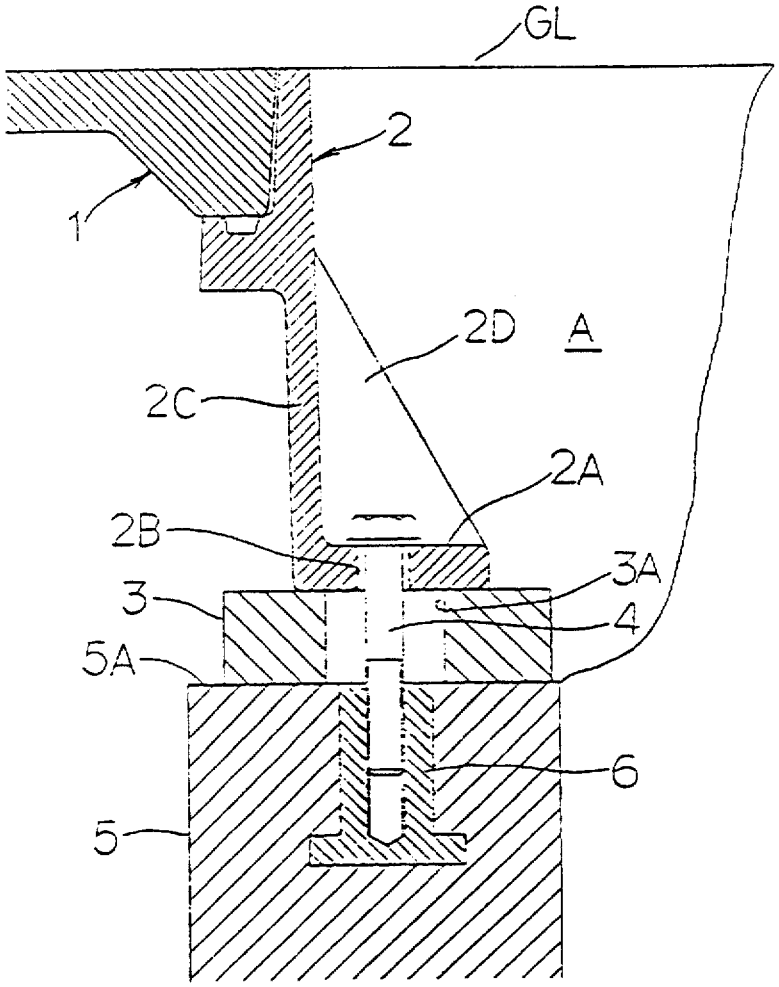
FIG. 10 (PRIOR ART)
FIG. 10 is an enlarged and cross sectional view of a mechanism for adjusting the height of a supporting frame of the manhole opening structure of FIG. 9.
Figure 11:
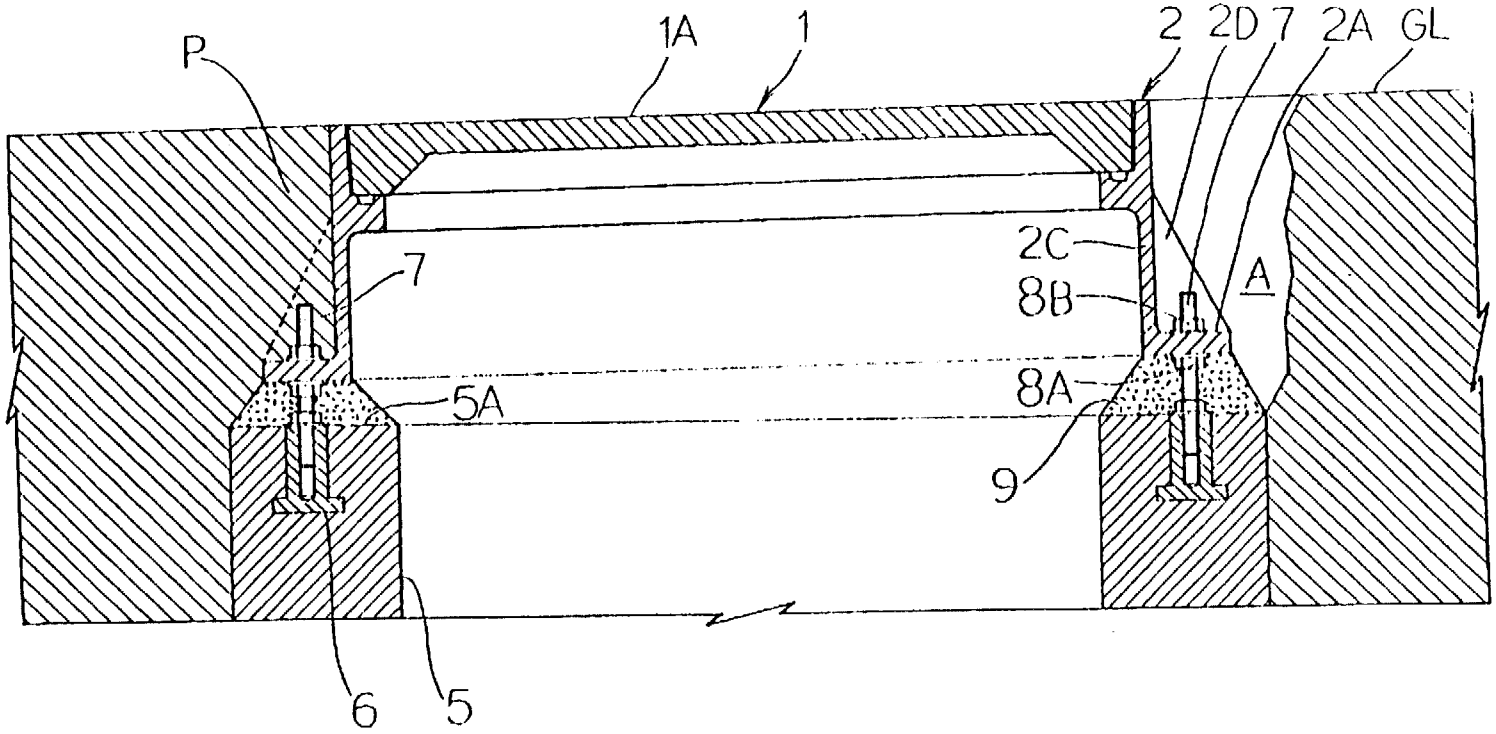
FIG. 11 (PRIOR ART)
FIG. 11 is an enlarged and cross sectional view of a mechanism for adjusting the height of a supporting frame of the manhole opening structure constructed in accordance with another prior art.

There is also provided a fastener means 29 to fasten the supporting frame 21 to the manhole body 5 on the upper face 5A. As shown in FIG. 8, the fastener means 29 may comprise a fastening portion or flange 30 horizontally and inwardly extending from the lower edge of the supporting frame 21. Fastener bolts 31 extend through bolt insertion holes 30A in the fastening flange 30 and insert nuts 32 are inserted or buried in the manhole body 5 so that they are exposed to the opening upper face 5A of the manhole body 5.

Figure 2:
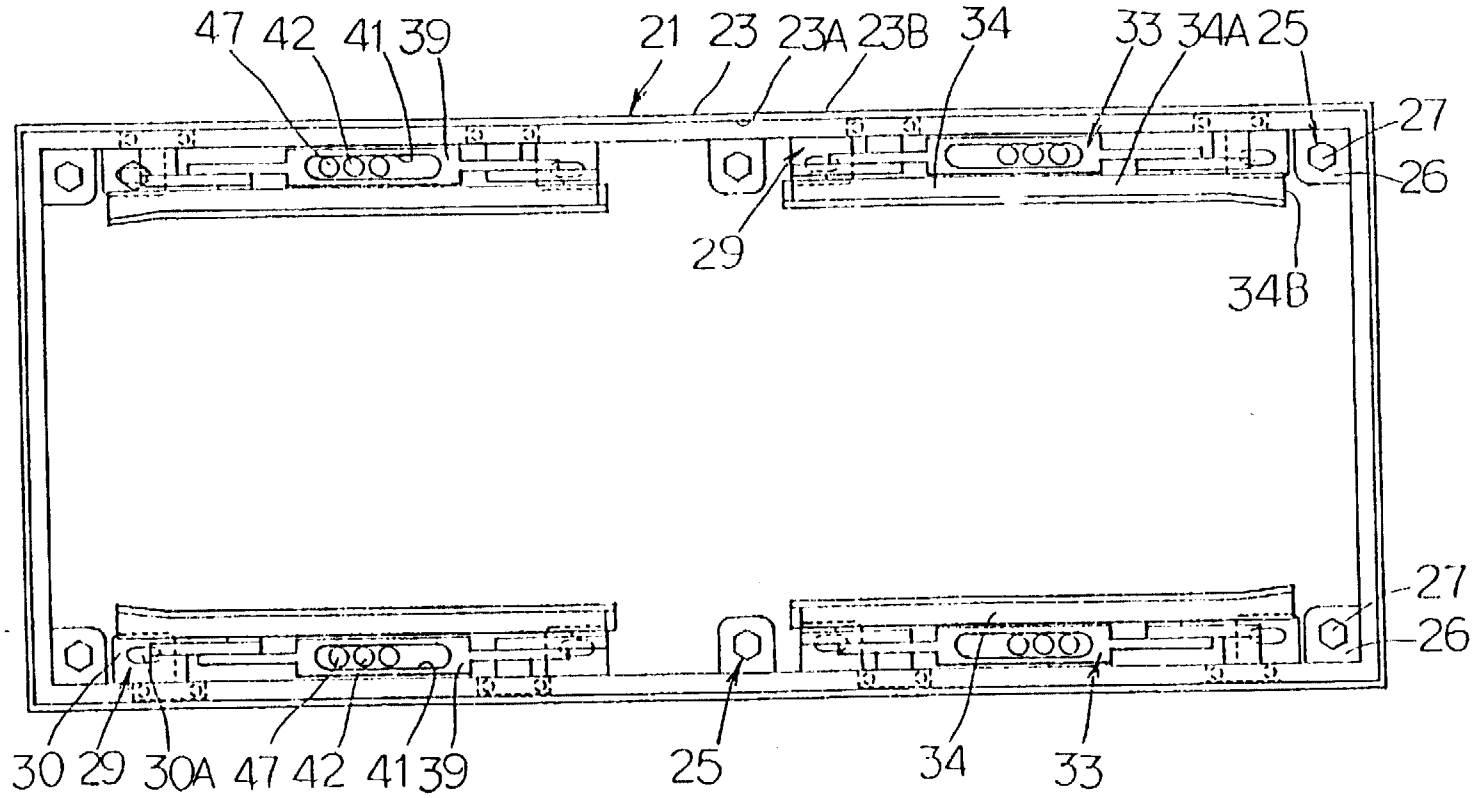
FIG. 2 is a plan view of the supporting frame shown in FIG. 1.
Figure 5:
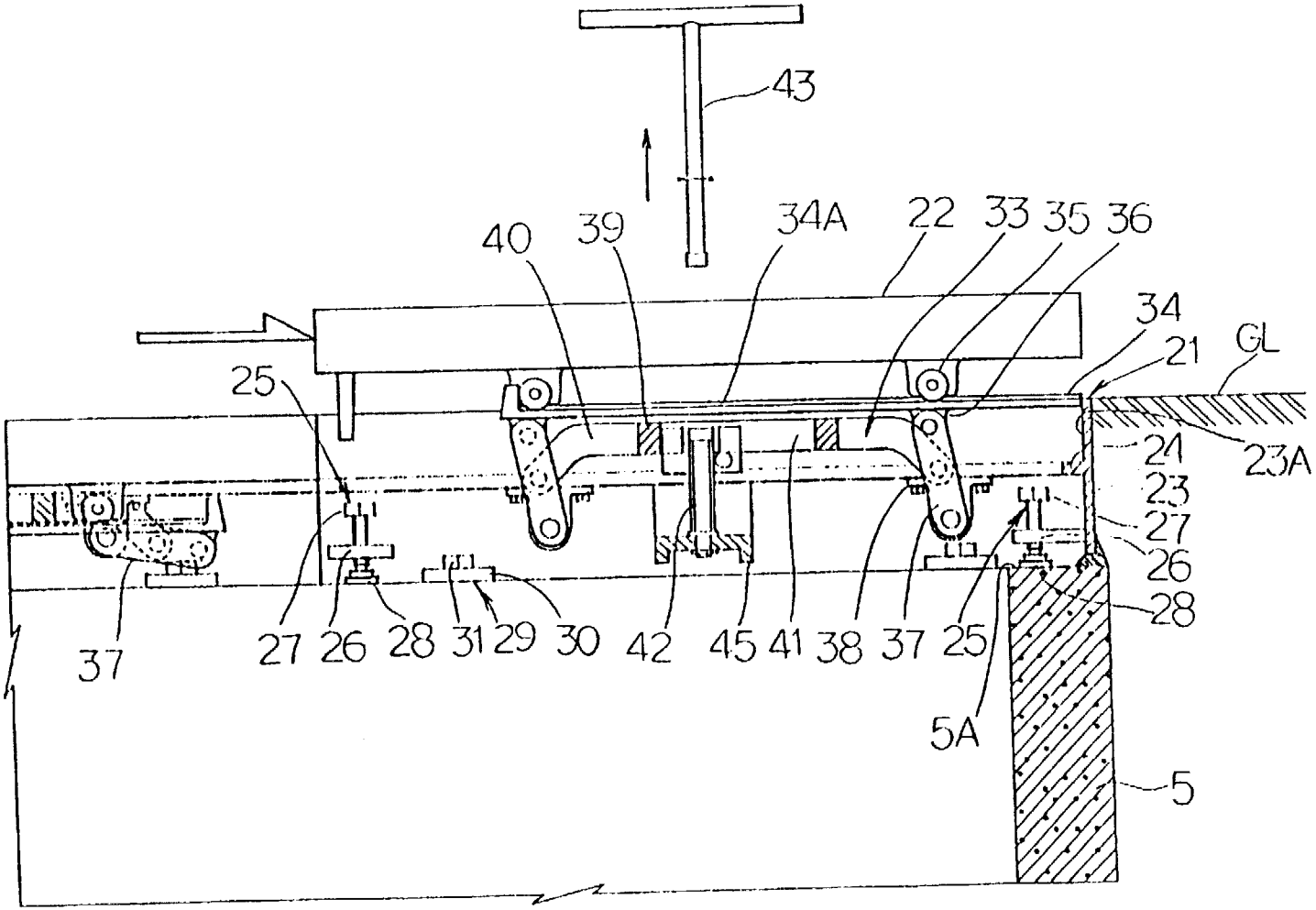
FIG. 5 is an enlarged sectional view of the manhole opening structure according to the present invention.

As shown in FIGS. 2 and 5, there is provided a rail lifter 33 to allow upward and downward movement of a pair of cover traveling rails 34 which are in turn provided in parallel to each other along inner faces 23A of the inlet portion 21. The respective manhole covers 22 have four wheels 35 provided on a lower face and mounted on rail faces 34A of the traveling rails 34 so that the manhole covers 22 can travel longitudinally on the rails 34.

Figure 3:
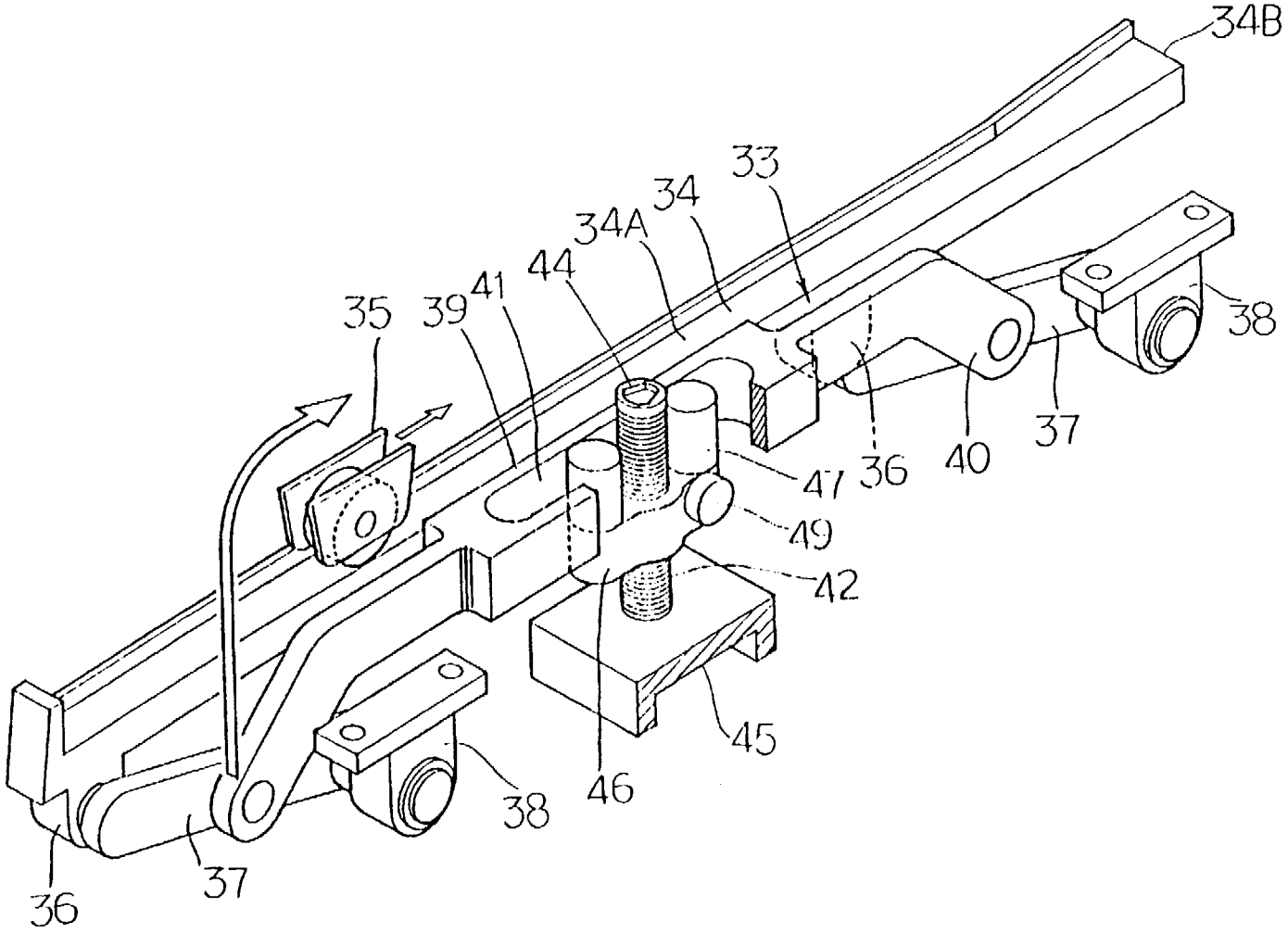
FIG. 3 is an enlarged perspective view of a lifter used for the manhole opening structure of the invention with a portion thereof omitted.
Figure 4:
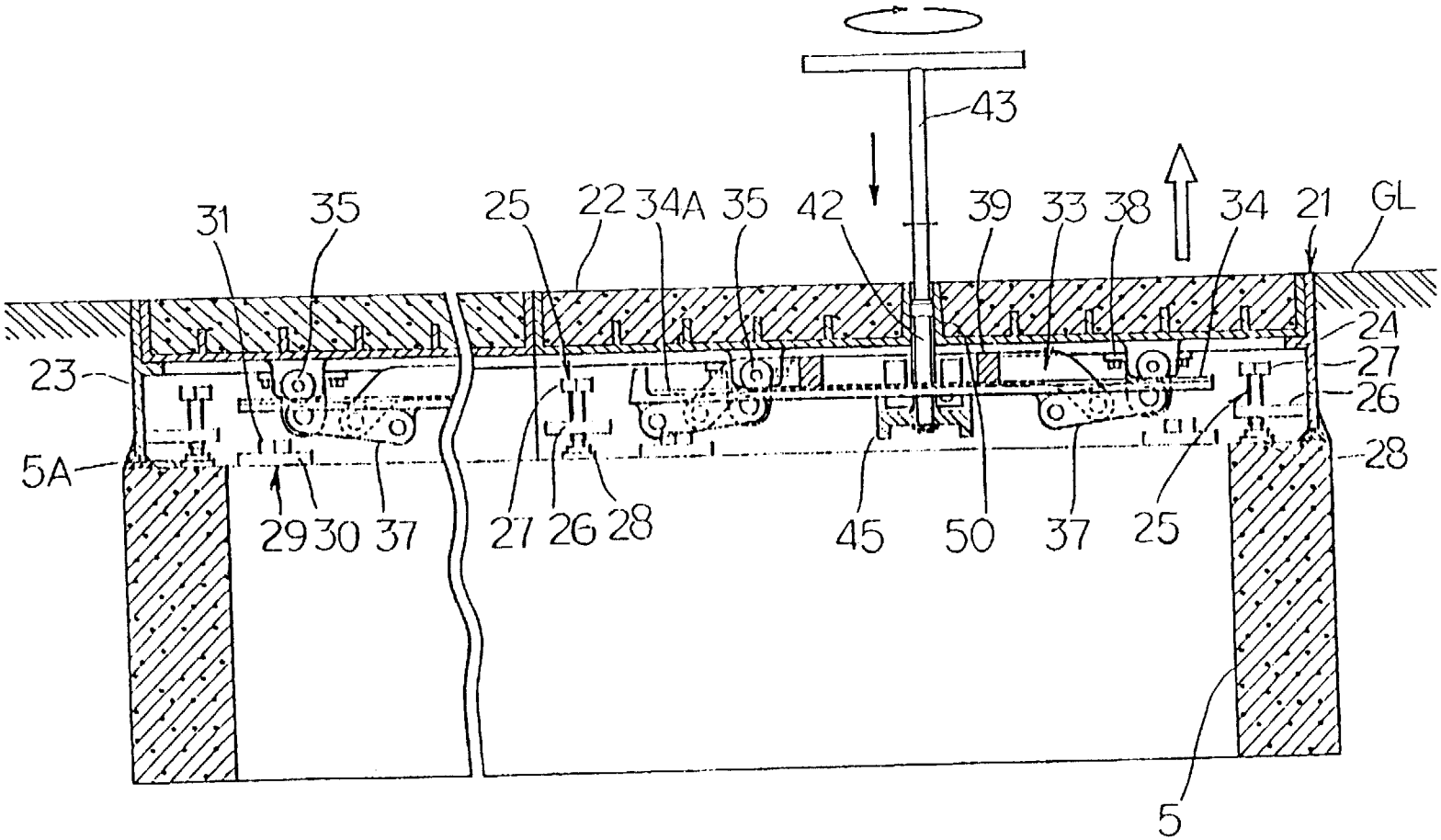
FIG. 4 is a sectional view of the manhole opening structure of the invention.

As shown in FIGS. 3 and 5, each of the rails 34 may have two bearings 36 provided on a lower face and spaced from each other in a longitudinal direction. The bearings 36 have shaft holes having an axis extending in a direction perpendicular to the longitudinal direction of the rails 34. Links 37 are pivotally mounted on the bearings 36 with pivotal shafts on the links 37 being supported in the shaft holes in the bearings 36. The other ends of the links 37 are pivotally mounted on bearings 38, which are in turn provided on longitudinal walls of the supporting frame 21 in a spaced manner. Thus, it will be noted that a parallelogram linkage is formed by the supporting frame 21, the rails 34, and two links 37. This allows the rails 34 to move upwardly and downwardly, and in a rightward and leftward direction, as viewed in FIGS. 3 and 5, while the rail faces 34A thereof are maintained in a horizontal manner.

As shown in FIGS. 3 and 5, a rectangular transmission member 39 may have arms 40 extending from front and rear ends in a downwardly inclined manner. The arms 40 at their ends are pivotally mounted on the two links 37 at their center portions so that they are disposed in a manner parallel to the rails 34. A longitudinal hole or groove 41 of predetermined length may be provided in the transmission member 39 at its center in a manner parallel to the longitudinal direction of the rails 34. A longitudinal hole or groove 41 of predetermined length may be provided in the transmission member 39 at its center in a manner parallel to the longitudinal direction of the rails 34. As noted from FIGS. 3 and 5, the longitudinal hole 41 is provided such that it extends vertically through the transmission member 39.

A lifter screw 42 extends vertically through the longitudinal hole 41 and has a socket 44 provided in an upper end. The socket 44 of the lifter screw 42 is used for engaging a lower end of a lifting tool 43 which may be T shaped. The lifter screw 42 at its lower end may engage a plane bearing 45 so that the lifter screw 42 can rotate, but is prevented from being removed out of the plane beating 45. The plane bearing 45 is secured to the supporting frame 21.

As particularly shown in FIG. 3, a lifter body 46 threadedly engages the lifter screw 42 and may have a pair of cylindrical rotation controllers 47 provided on both sides of the lifter body 46, such that the lifter screw is positioned between the cylindrical rotation controllers 47. The cylindrical rotation controllers 47 movably engage the inner wall of the longitudinal hole 41 in the transmission member 39. Thus, it will be noted that the lifter body 46 is prevented from rotating in the longitudinal hole 41. A roller 49 may be provided on the side face of the lifter body 46 such that it engages a lower face of the transmission member 39. The roller 49 serves to move the cover traveling rails 34 upward together with the lifter body 39.

It will be noted that the lifter screw 42 and the lifter body 46 constitute a jack for driving the linkage.

A tool insertion hole 50 may be formed in the manhole cover 22 in alignment with an axis of the lifter screw 42 of the jack when the manhole cover 22 closes the inlet portion 21A in the supporting frame 21. The lifting tool 43 is inserted through the tool insertion hole 50 in the manhole cover 22 until it contacts the lifter screw 42. A cap 51 may be used for closing the tool insertion hole 50 so as to prevent dust from entering the lifter screw 42 through the tool insertion hole 50.

In operation where the manhole cover 22 is mounted on the upper face 5A of the manhole body 5, the supporting frame 21 is fastened to the manhole body 5 on the upper face 5A. Subsequently, the manhole cover 22 falls down into the supporting frame 21 so as to be supported thereon.

The supporting frame 21 is disposed over the opening of the manhole body 5 while the thrust pad 28 for the adjusting mechanism 25 is mounted on the upper face 5A of the manhole body 5 in order to adjust the height and the inclination of the supporting frame 21 in accordance with the height and the inclination of the road surface GL.

Figure 6:
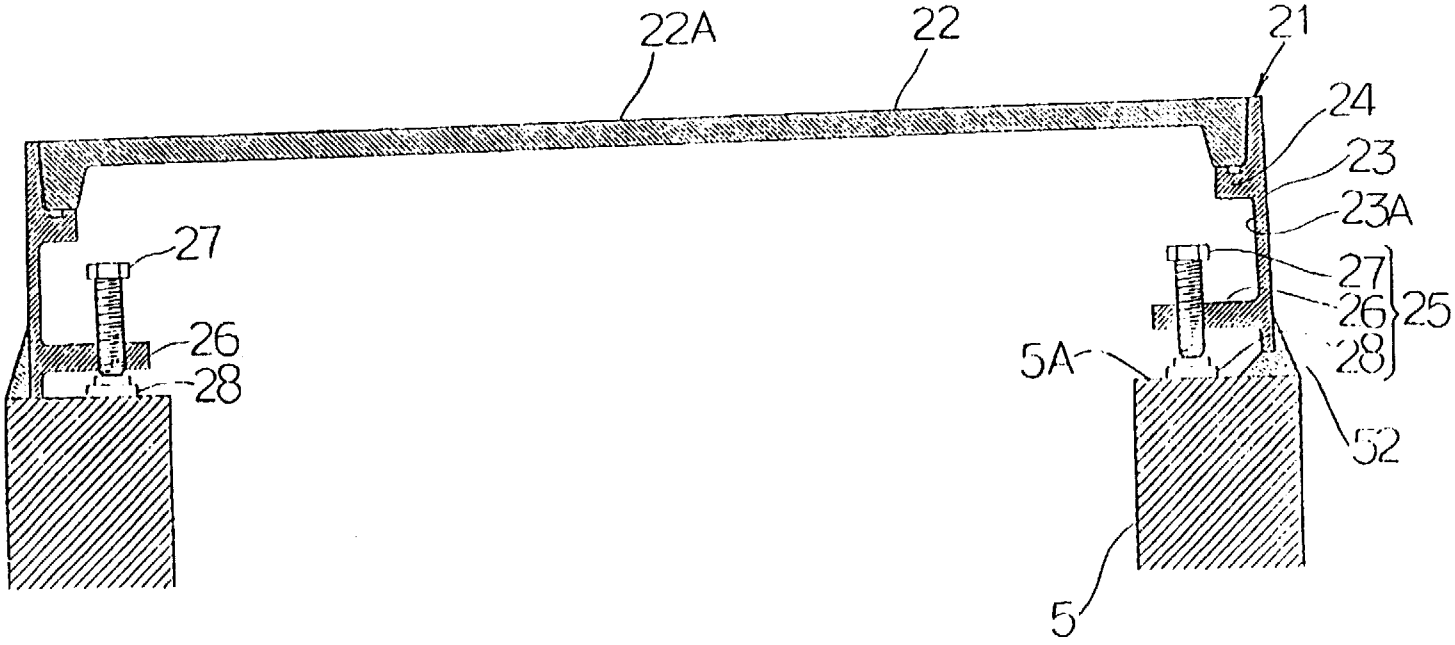
FIG. 6 is a cross sectional view of a mechanism for adjusting the height and inclination of the supporting frame used for the invention.

As shown in FIGS. 6 and 7, adjustments are made by rotating the adjusting bolts 27. A rotation of the adjusting bolts 27 causes the supporting frame 21 to move upwardly or downwardly through the support portions 26 which the adjusting bolts 27 threadedly engage. Thus, the height of the supporting frame 21 is adjusted while a distance is maintained between the lower end 23B of the side wall 23 and the upper face 5A of the manhole body 5. This height adjustment of the supporting frame 21 serves to align the upper face of each of the manhole covers 22 with the road surface GL.

Adjusting bolt 27 at its lower end rotates with an angular displacement relative to the thrust pad 28. Because of this, the load of the supporting frame 21 is uniformly dispersed over the upper face 5A of the manhole body 5 to which the bottom face 28A of the thrust pad 28 engages. In addition, the adjusting bolt 27 at its lower end rotatably engages the corresponding thrust pad 28, which never rotates even though the adjusting bolt 27 rotates. Because only the adjusting bolt 27 can rotate without any resistance, the upper face of the supporting frame 21 can easily be aligned with the road surface GL.

It will be noted that the supporting frame 21 can be installed on the manhole body 5 while the inclination of the supporting frame 21 is adjusted relative to the upper face 5A of the manhole body 5. In this case, since the adjusting bolt 27 pivotally engages the thrust pad 28, the adjusting bolt 27 can move upwardly and downwardly while it is inclined relative to the corresponding thrust pad 28. This enables the bottom face 28A of the thrust pad 28 to be kept against the upper face 5A of the manhole body 5 in a stable manner. Thus, the adjusting bolt 27 can smoothly rotate so that the inclination of the supporting frame 21 is easily aligned with that of the road surface GL.

After the height and inclination adjustments are complete, the fastening bolts 31 are inserted through the bolt insertion holes 30A in the fastening flange 30 and are tightly threaded into the insert nuts 32 in the manhole body 5 at its upper face 5A. This fastens the supporting frame 21 onto the upper face 5A of the manhole body 5. Thereafter, mortar is placed between the lower end of the supporting frame 21 and the upper face 5A of the manhole body 5 to seal the space between them.

As the manhole sinks or goes down irregularly after its installment, the manhole covers 22 have to be again adjusted in their level so as to be aligned with the road surface GL. It should be understood that since the adjusting mechanism 25 and the fastener means 29 are disposed within the side wall 23 of the supporting frame 21, the ground around the periphery of the supporting frame 21 and contacting the outer face of the side wall 23 can be dug just over a limited range in order to again align the manhole covers 22 with the road surface GL. After the manhole covers 22 are opened, the operation of adjusting the height and inclination of the supporting frame 21 can be made within the space of the inlet portion 21A of the supporting frame 21.

As the two manhole covers 22 fall into the inlet portion 21A in the supporting frame 21, they are supported on the supporting flange 24 of the supporting frame 21 on the inner side 23A as shown in FIG. 4. The four wheels 35 on the lower faces of the covers 22 are mounted on the rail faces 34A of a pair of rails 34 so that the inlet portion 21A and the upper face 5A of the manhole body 5 are closed.

As the manhole cover 22 is to be opened from the condition shown in FIG. 4, the lifting tool 43 is inserted through the insertion hole 50 in the manhole cover 22 until it engages the socket 44 of the lifting screw 42. Thereafter, as the lifting tool 43 rotates in a direction in which the lifter body 46 lifts, the lifter body 46 moves upward lifting screw 42 without any rotation relative to the manhole body 5 because the rotation controllers 47 engage the inner wall of the longitudinal hole 41 in the transmission member 39. Consequently, the transmission member 39 is lifted by the roller 49 secured to the lifter body 46.

As a result, the cover traveling rails 34 move upward through the links 37 swinging about the axes of the bearings 36 and 38 as indicated by an arrow in FIG. 3 while they advance in a rightward direction within the longitudinal hole 41. As the cover traveling rails 34 move upward, the corresponding manhole cover 22 mounted on the rail faces 34A also tries to move upward while moving in a rightward direction as viewed in FIG. 1. The manhole cover, 22 however, is only vertically lifted due to the lifting tool 43 being inserted through the tool insertion hole 50 in the manhole cover 22 so as to restrain the manhole cover 34 from moving in a lateral direction.

As shown in FIG. 5, when the links 37 are raised, the edges 34B of the rails 34 engage the righthand inner face 23A of the supporting frame 21 so that the rail faces 34A of the rails 34 are aligned with the road surface GL.

Thus, after the lifting tool 43 is removed from the insertion hole 50 in the manhole cover 22, the manhole cover 22 is pushed in a rightward direction as viewed in FIG. 5 and travels on the rail faces 34A of the rails 34 onto the road surface GL so as to open the upper face 5A of the manhole.

When the manhole cover 22 disposed on the road surface GL as shown in FIG. 1 is to be replaced, the manhole cover 22 is pushed toward the supporting frame 22 in a horizontal manner until the front and rear wheels 35 on the manhole cover 22 fully engage the rail faces 34A of the rails 34 away from the road surface GL.

Thereafter, the lifting tool 43 is inserted through the insertion hole 50 in the manhole cover 22 until it engages the socket 44 of the lifting screw 42. It is then rotated in a direction opposite to that in which the rails 34 are lifted. Thus, the lifting body 46, together with the corresponding rail 34, moves downward while moving in a leftward direction as viewed in FIG. 3 until the manhole cover 22 engages the inlet portion 21A of the supporting frame 21 to close the upper face 5A of the manhole.

Although a single embodiment of the invention has been described and illustrated with reference to the accompanying drawings, it will be understood by those skilled in the art that it is only one example, and that various changes and modifications may be made without departing from the spirit and scope of the invention, which is defined only by the appended claims.

What is claimed is:

1. A manhole opening structure comprising:

a manhole body having an upper face, a supporting frame having an inner surface fastened to said upper face of said manhole body and having an inlet portion, at least one manhole cover adapted to removably close said inlet portion, said manhole cover having a lower surface and wheels attached to said lower surface, at least two manhole cover traveling rails provided in parallel to each other, said traveling rails being pivotally affixed to said inner surface of said supporting frame such that said traveling rails are adapted to move between a first position and a second position substantially parallel to said first position, said traveling rails supporting said wheels to which said manhole cover is attached, and a rail lifter attached to each of said rails to upwardly and downwardly move said rails between said first and second positions, whereby said manhole cover closes said inlet portion when said traveling rails are moved down by said rail lifter into said first position and opens said inlet portion when said traveling rails are moved up by said rail lifter to said second portion to lift said manhole cover out of said supporting frame and said wheels on said manhole cover travel along said traveling rails to move said manhole cover laterally away from said inlet portion.

2. A manhole opening structure as set forth in claim 1, wherein said rail lifter comprises a linkage including:

two links, each having a first and a second end, which are pivotally supported at said first end by a bearing attached to one of said traveling rails and at said second end by a bearing attached to said supporting frame, jack means connected to both of said two links to drive said linkage and thereby to move said traveling rails upwardly and downwardly.

3. A manhole opening structure as set forth in claim 2, wherein said jack means comprises:

a lifter body threadedly engaging a lifting screw supported on said supporting frame, and a transmission member supported on said lifter body and having two member ends, each member end pivotally attached to one of said links, whereby said transmission member moves upwardly and downwardly as said lifting screw rotates.

4. An adjusting mechanism for a supporting frame on which a manhole cover is supported, said supporting frame having at least one side wall, said side wall having an inner and an outer face, said adjusting mechanism comprising:

adjusting bolts threadedly engaging support portions that extend inwardly from said inner face of said supporting frame so that said adjusting bolts move upwardly and downwardly when said adjusting bolts rotate, wherein said support portions are attached to said inner face in a cantilevered manner, and thrust pads engaging an opening upper face of a manhole and supporting said adjusting bolts so that said adjusting bolts can rotate while they are able to be angularly displaced relative to said thrust pads, wherein said adjusting mechanism is disposed entirely within said inner face of said side wall of said supporting frame and wherein said side wall of said supporting frame is substantially vertical, said side wall lacking any protrusion provided on said outer face of said side wall.

* * * * *

UNITED STATES PATENT AND TRADE MARK OFFICE

CERTIFICATE OF CORRECTION

PATENT NO. : 5,732,512
DATED : March 31, 1998
INVENTOR(S) : Takashi Ueno and Tsutomu Taneichi It is certified that error appears in the above-identified patent and that said Letters Patent is hereby corrected as shown below:

Claim 1, column 8, line 16, "portion" should be "position".

Signed and Sealed this

Twenty-second Day of September, 1998

*Attest:*

Bruce Lehman

BRUCE LEHMAN

*Attesting Officer*

*Commissioner of Patents and Trademarks*